US006945197B2

(12) United States Patent
Ryoo

(10) Patent No.: US 6,945,197 B2
(45) Date of Patent: Sep. 20, 2005

(54) WATER HEATER

(75) Inventor: Young Ryoo, Ansan-si (KR)

(73) Assignee: Grand Hall Enterprise Co., Ltd., Taipei (TW)

( * ) Notice: Subject to any disclaimer, the term of this patent is extended or adjusted under 35 U.S.C. 154(b) by 46 days.

(21) Appl. No.: 10/745,494

(22) Filed: Dec. 29, 2003

(65) Prior Publication Data

US 2005/0139172 A1 Jun. 30, 2005

(51) Int. Cl.[7] ..... F22B 1/02
(52) U.S. Cl. ..... 122/15.1; 122/18.1; 122/31.1
(58) Field of Search ..... 122/15.1, 18.1, 122/31.1, 31.2, 36; 392/451, 482, 483

(56) References Cited

U.S. PATENT DOCUMENTS 4,280,450 A * 7/1981 Maruyama ..... 122/13.01
5,546,760 A * 8/1996 Cook et al. ..... 62/497
5,816,496 A * 10/1998 Kovacs ..... 237/78 R
6,223,698 B1 * 5/2001 Lacaze ..... 122/31.2

* cited by examiner

*Primary Examiner*—Gregory Wilson
(74) *Attorney, Agent, or Firm*—Leong C. Lei

(57) ABSTRACT

A water heater which includes a heat exchanger having a first passage and a second passage connected with the first passage, a gas burner mounted within the first passage, a push blower having an outlet conmected with the gas burner for forcing air into the gas burner, and a water reservoir mounted surrounding the heat exchanger, whereby when the gas burner is turned on, the push blower will be turned on to force air into the gas burner thereby forcing combustion air generated from fire of the gas burner to move along the first passage and meanwhile the pull blower will be turned on to extract the hot air out of the second passage.

9 Claims, 2 Drawing Sheets

WATER HEATER

BACKGROUND OF THE INVENTION

1. Field of the Invention

This invention is related to a water heater and in particular to one which can supply hot water continuously at a steady temperature and low drop in pressure.

2. Description of the Prior Art

The conventional storage water heater simply comprises a housing with a flue tube at the center, a burner mounted under the flue tube, a cold water inlet pipe extending downwardly through the housing, and a hot water outlet extending upwardly through the housing. Nevertheless, such a water heater is bulky in volume, requiring a relatively large space for installation. Further, the efficiency of such a water heater is only 60% and it takes about 40–60 minutes to heat up the water and the temperature of the water heater cannot be adjusted.

Therefore, it is an object of the present invention to provide an improved water heater which can obviate and mitigate the above-mentioned drawbacks.

SUMMARY OF THE INVENTION

This invention is related to an improved water heater.

It is the primary object of the present invention to provide an improved water heater which has a high efficiency.

It is another object of the present invention to provide an improved water heater which will draw secondary air into the combustion chamber for providing complete combustion as well as reducing the temperature of the inner surface of the inner cylindrical passage thereby prolonging the service life of the heat exchanger.

It is another object of the present invention to provide an improved water heater which can supply hot water at a steady temperature.

It is still another object of the present invention to provide an improved water heater which has a low pressure drop when two or more faucets connected with the water heater are opened for use.

It is still another object of the present invention to provide an improved water heater which is self-cleaning thereby preventing the accumulation of water scales.

It is still another object of the present invention to provide an improved water heater in which the condensation water will be collected at the inside bottom of the heat exchanger and will be vaporized in normal operation and exhausted with the flue gas.

It is a further object of the present invention to provide an improved water heater in which the water reservoir is positioned surrounding the heat exchanger thereby eliminating the insulation for protection from combustion area.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon mnakng reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 2:
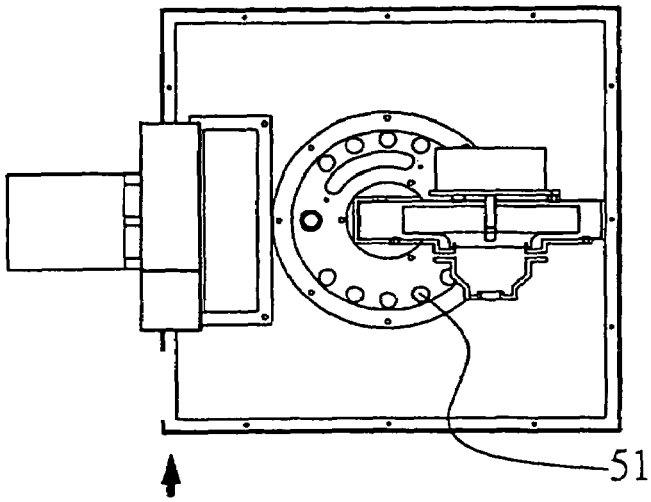
FIG. 2 is a top plan view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 1:
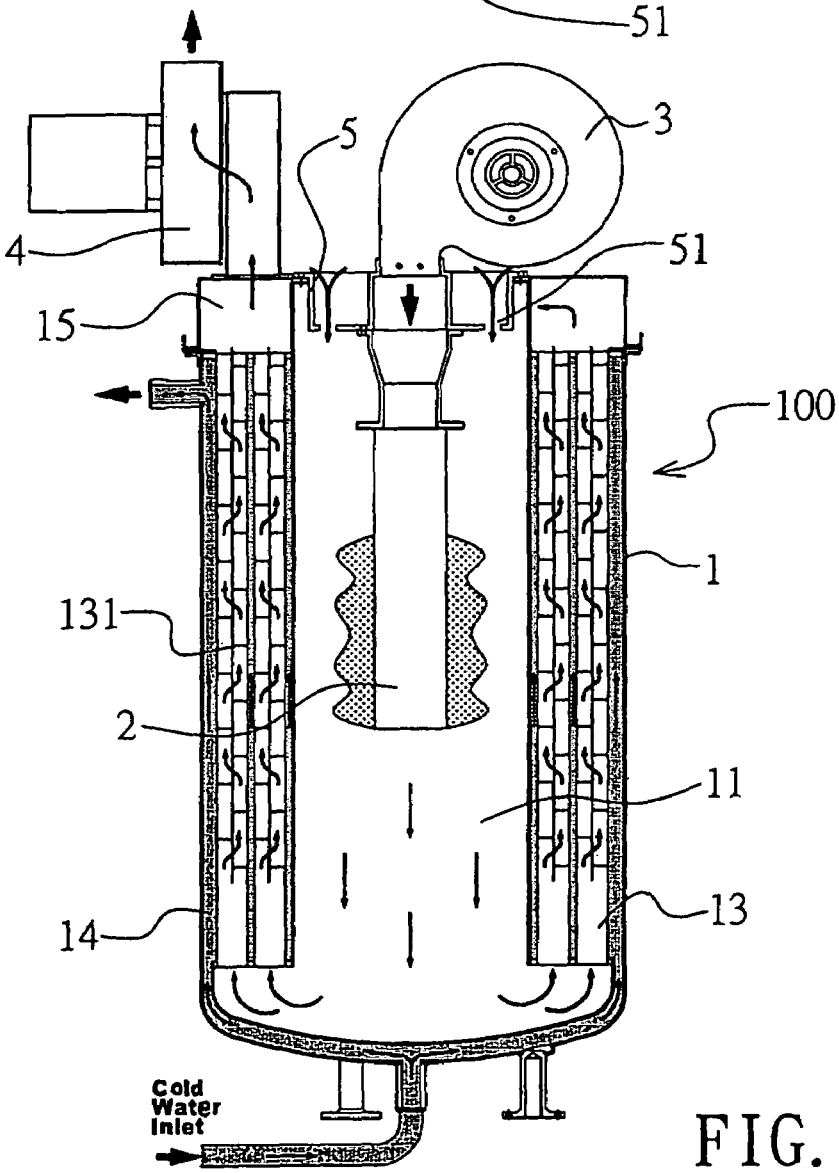
FIG. 1 is a longitudinal sectional view of the present invention.
Figure 4:
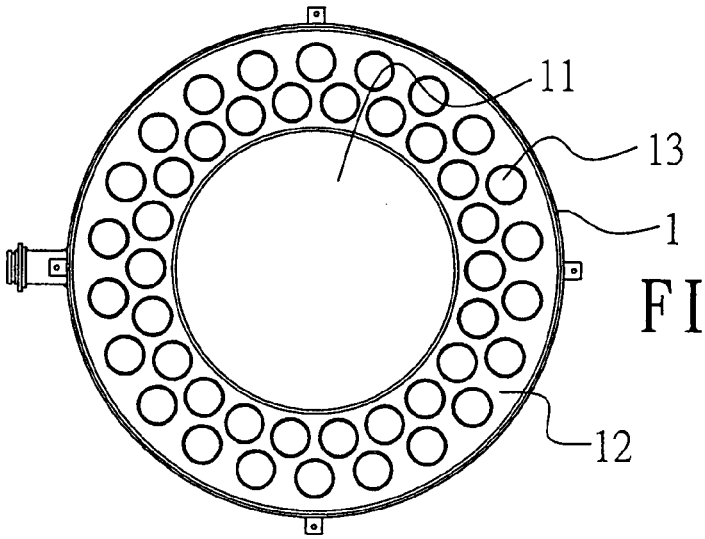
FIG. 4 is an enlarged top plan view of the heat exchanger.
Figure 3:
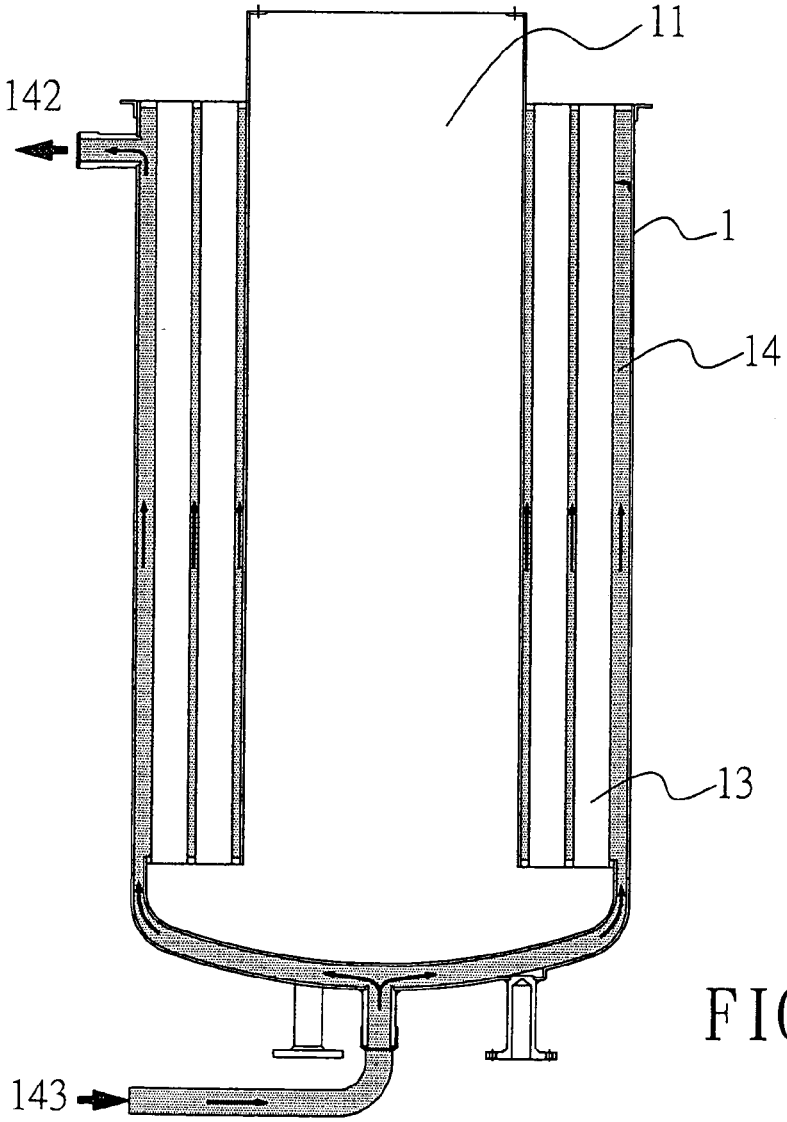
FIG. 3 is an enlarged sectional view of the heat exchanger.

With reference to FIGS. 1 and 2, the water heater 100 according to the present invention mainly comprises a heat exchanger 1, a gas burner 2, a push blower 3, a pull blower 4, and a top panel 5. As shown in FIGS. 3 and 4, the heat exchanger 1 is a cylindrical housing formed with an inner cylindrical passage 11 at the center and an annular outer passage 12 surrounding the inner cylindrical passage 11. A plurality of flue tubes 13 are fitted within the annular outer passage 12. An exhaust chamber 15 is provided above the upper ends of the tubes 13. The outer layer of the heat exchanger 1 is formed with a water reservoir 14 for receiving water. The water reservoir 14 encloses the bottom of the heat exchanger 1 and has a concaved inside bottom. Within each of the flue tubes 13 are mounted a plurality of baffles 131 for slowing the flow rate of the combustion gas flue in the flue tubes 13. The gas burner 2 is mounted within the cylindrical passage 11 of the heat exchanger 1. The push blower 3 is installed on the top of the heat exchanger 1 and has an outlet extending downwardly to engage with the burner 2. The pull blower 4 is mounted on the top of the heat exchanger 1 and connected with the exhaust chamber 15. The top panel 5 is mounted on the top of the inner cylindrical passage 11 and formed with a plurality of secondary air inlet holes 51 for drawing fresh air into the inner cylindrical passage 11. The bottom of the water reservoir 14 is connected to a cold water inlet (see FIG. 1), while the upper end of the water reservoir 14 has a hot water outlet 142.

As the gas burner 2 is turned on, air and gas will mix together properly before combustion to produce a perfect combustion so as to lead to no harmful emission. In the meantime, the push blower 3 is turned on to supply air into the gas burner 2 thereby supplying excessive oxygen to the combustion and forcing the combustion air of the gas burner 2 to go downwardly along the inner cylindrical passage 11. At the same time, the pull blower 4 is turned on to extract the combustion air upwardly along the flue tubes 13 and then out of the exhaust chamber 15. When the combustion air flows through the flue tubes 13, the baffles 131 will slow down the flow rate of the combustion air and will keep the combustion air in the flue tubes 13 as long as possible thereby effectively transferring the heat from the combustion air to the flue tubes 13 which will then transfer the heat to the water reservoir 14. The water reservoir 14 is positioned surrounding the flue tubes 13 so that the heat from the combustion air will be prevented from getting out directly from the flue tubes 13 to the air. On the other hand, the water reservoir 14 is also used as an insulator and so it is unnecessary to cover a very thick outer liner on the outer side of the water reservoir 14. As the push blower 3 is turned on, the flow rate of the gas inside the inner cylindrical passage 11 will be increased thereby decreasing the pressure inside the inner cylindrical passage 11 with respect to the atmospheric pressure and therefore attracting air to pass through the secondary air inlet holes 51 into the inner cylindrical passage 11. The air passing through the secondary air inlet holes 51 will provide a complete combustion as well as reduce the temperature of the combustion air thus providing the optimum temperature for heat transfer and prolonging the service life of the heat exchanger 1. Furthermore, the condensation water will be collected at the inside bottom of the heat exchanger 1 and will be vaporized in normal operation and exhausted with the flue gas. Moreover, no condensation will occur on the outer surface of the heat exchanger 1.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water heater comprising:

a heat exchanger having a first passage and a second passage connected with said first passage;

a gas burner mounted within said first passage;

a push blower having an outlet connected with said gas burner for forcing air into said gas burner;

a water reservoir mounted surrounding said heat exchanger; and a top panel mounted on an inlet of said first passage and having a plurality of holes for passing of secondary air into said first passage;

whereby when said gas burner is turned on, said push blower will be turned on to force air into said gas burner thereby forcing combustion air from said gas burner to move along said first passage and then out of said second passage.

2. The water heater as claimed in claim 1, further comprising a water reservoir formed on an outer layer of said heat exchanger.

3. The water heater as claimed in claim 1, further comprising a plurality of flue tubes are mounted within said second paggage.

4. The water heater as claimed in claim 3, wherein said flue tubes are provided with bqaffles for slowing flow rate of combustion air.

5. The water heater as claimed in claim 1, wherein said first passage is arranged at an inner portion of said heat exchanger, and said second passage is arranged at an outer portion of said heat exchanger.

6. The water heater as claimed in claim 1, further comprising a pull blower having an inlet connected with said second passage for extracting combustion air from said gas burner out of said second passage.

7. The water heater as claimed in claim 1, further comprising an exhaust chamber above said second passage.

8. The water heater as claimed in claim 1, wherein said water reservoir encloses a bottom of said heat exchanger which is connected with a water inlet.

9. The water heater as claimed in claim 8, wherein said water reservoir has a concaved inside bottom.

* * * * *